United States Patent [19]

Mazur

[11] 4,453,637

[45] Jun. 12, 1984

[54] DOUBLE COMPARTMENT VALVE BAG

[75] Inventor: Jeffrey A. Mazur, Pittsburgh, Pa.

[73] Assignee: General Refractories Company, Bala Cynwyd, Pa.

[21] Appl. No.: 456,695

[22] Filed: Jan. 10, 1983

Related U.S. Application Data

[63] Continuation of Ser. No. 233,460, Feb. 11, 1981, abandoned.

[51] Int. Cl.[3] ..... B65D 27/08; B65D 27/38

[52] U.S. Cl. ..... 206/602; 206/568; 206/617; 206/618; 383/37; 383/38; 383/53

[58] Field of Search ..... 141/68, 325; 229/53, 229/56, 62.5; 206/0.5, 602, 616, 617, 618, 568; 604/409, 410; 150/9; 73/863.41; 383/37, 38, 53, 54

[56] References Cited

U.S. PATENT DOCUMENTS

| | | | |
|---|---|---|---|
| 2,333,643 | 11/1943 | Donnellan | 150/1 |
| 2,791,505 | 5/1957 | Barnett | 206/0.5 |
| 3,187,750 | 6/1965 | Tenczar, Jr. | 604/410 |
| 3,304,977 | 2/1967 | Hammons | 604/409 |
| 3,618,286 | 11/1971 | Membrino | 229/53 |
| 3,802,919 | 4/1974 | Saffir | 150/1 |
| 3,941,306 | 3/1976 | Weikert | 229/53 |
| 4,021,283 | 5/1977 | Weikert | 229/53 |

*Primary Examiner*—Stephen P. Garbe

*Attorney, Agent, or Firm*—Finnegan, Henderson, Farabow, Garrett & Dunner

[57] ABSTRACT

A closed bag containing two independent compartments has a single opening for filling both compartments simultaneously, the compartments being separable from each other so they can be moved independently.

6 Claims, 11 Drawing Figures

DOUBLE COMPARTMENT VALVE BAG

This is a continuation of application Ser. No. 233,460, filed 2/11/81, now abandoned.

BACKGROUND OF INVENTION

This invention relates to the field of bags and, in particular, to bags containing substantial amounts of dense material.

In recent years, the call for lighter weight packages for dense materials such as cement, sand, building materials, etc., has emanated from various sources. Customers, labor unions, and government regulations are all demanding that packages of heavy material be easier and safer to lift.

In the refractory and cement industries, for example, filled bags of cement weighing 100 lbs. are recognized as potential health hazards. Lifting these bags has been identified as a possible source of back injuries reported by workers in those industries. It appears that conventional bags will soon have to be replaced with smaller, lighter-weight units.

The successful conversion to smaller bags may be hindered by many problems, which, unfortunately, may prolong the potential health hazards. For example, if the bags currently used are replaced with smaller bags having half the current capacity, then the number of bags required for each ton of material will double. This increased handling will boost costs to manufacturers and consumers, with consumers having to absorb both their own increased cost and the increased manufacturing costs that will be passed on to them from the manufacturers.

In addition, manufacturing plants which now use the larger bags will need to replace or modify their packaging equipment to accommodate the smaller bags. These plants will probably also need to buy more packaging machines just to maintain current production levels.

At the same time, the bag manufacturers will have to double the number of bags they produce just to keep up with current demands. They may find doubling production to be difficult or even impossible.

SUMMARY OF THE INVENTION

The present invention overcomes these problems by providing a single bag having two separable compartments which are filled simultaneously through a single valve opening. The double-compartment bags are filled and handled in the same manner as are the conventional bags which are also filled through a single opening. Thus, new packaging equipment is unnecessary to handle the bags of this invention.

Furthermore, since the double-compartment bags have the same capacity as the present bags, each compartment having about half the capacity of conventional bags, the use of the double-compartment bags will not increase handling costs nor cause bag manufacturers' production levels to jump sharply because the present invention does not demand an increase in the numbers of bags required for each ton of material.

The filled, double-compartment bags can be transported and delivered to the final destination just as the conventional bags are currently handled. At the final destination, the two compartments can be separated so that only one compartment, weighing half as much as a conventional bag, needs to be lifted manually. The lighter package weight should reduce the number of injuries caused by lifting the large bags.

Additional objects and advantages of the invention will be obvious from the description which follows or may be learned by practice of the invention. The objects and advantages of the present invention may be realized and obtained by the instrumentalities recited in the appended claims.

To achieve the objects and in accordance with the purpose of the invention, as embodied and broadly described herein, the closed bag of this invention comprises two individual, compartments, a valve opening connected to both of the compartments for filling the compartments simultaneously, and means for disconnecting the compartments from each other.

The accompanying drawings, which are incorporated in and constitute a part of this specification, illustrate on embodiment of the invention and, together with the description, serve to explain the principles of the invention.

DESCRIPTION OF THE PREFERRED EMBODIMENT

Figure 1:
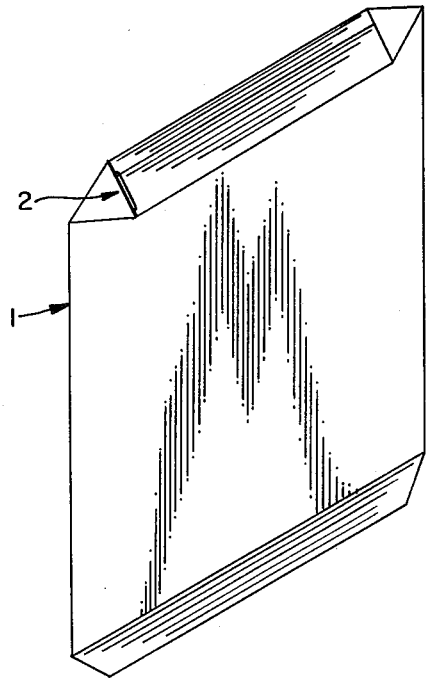
FIG. 1. (PRIOR ART)
FIG. 1 is a perspective view of a prior art bag in position to be filled.
Figure 2:
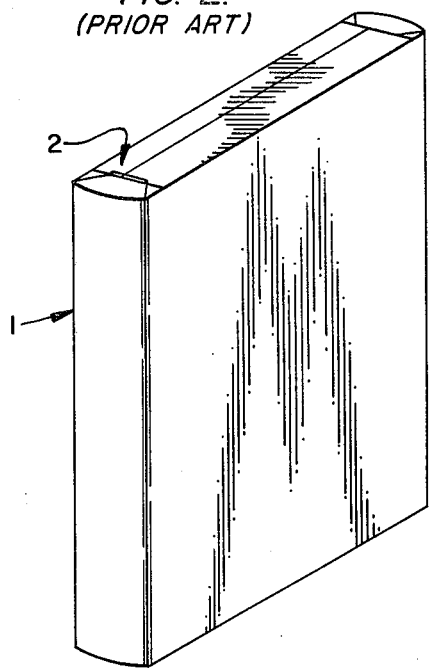
FIG. 2. (PRIOR ART)
FIG. 2 is a perspective view of the prior art bag after being filled.

A conventional bag in the refractory or cement industry is shown in FIGS. 1 and 2. The empty bag 1 can be stored in its collapsed state and is shown, in FIG. 1, in position to be filled.

The packaging devices which fill these bags have an outlet tube (not shown). The outlet tube enters valve opening 2, which is situated in the top of the bag 1. The material to be packaged is fed into bag 1 through the packaging device's outlet tube. A completely filled conventional bag is shown in FIG. 2.

Figure 3:
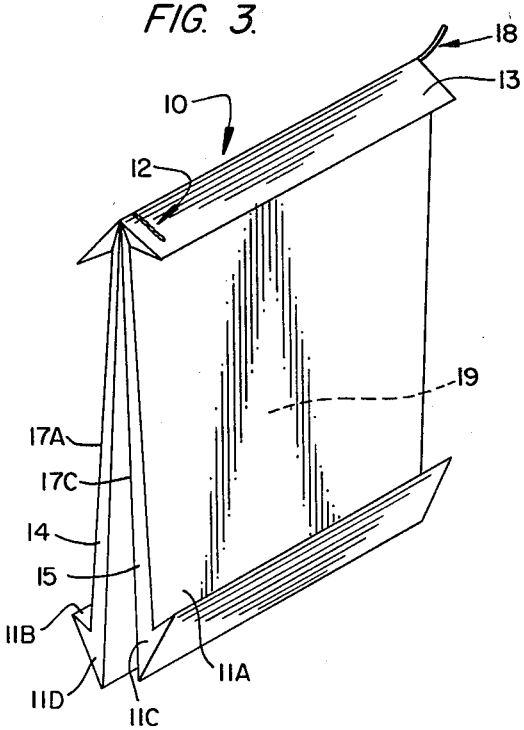
FIG 3. is a perspective view of the preferred embodiment of the double-compartment valve bag in position to be filled.
Figure 5:
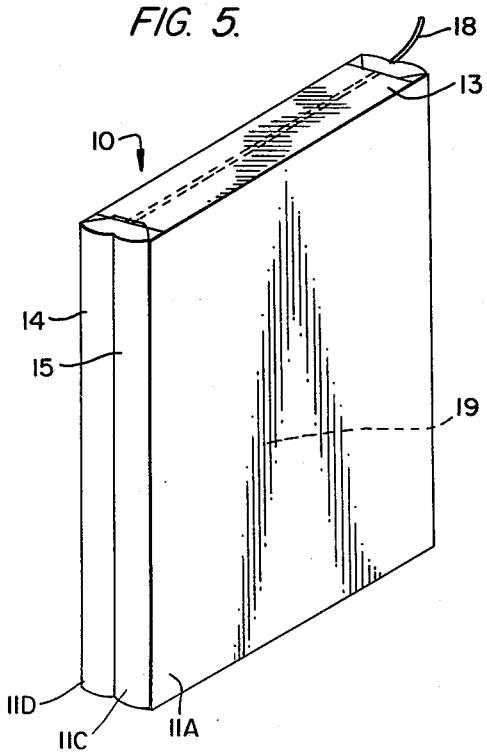
FIG. 5 is a perspective view of the preferred embodiment of the double-compartment valve bag after being filled.

A preferred embodiment of the present invention is illustrated in FIGS. 3–9. The double-compartment valve bag is represented by the numeral 10 and can be made from plastic or from multiwall paper. In FIG. 3, bag 10 is in a partially collapsed state, in FIG. 4, bag 10 is partially filled, and in FIGS. 5–8, has substantially the same volume and weight as does the filled conventional bag 1 shown in FIG. 2.

Bag 10 includes two individual closed compartments 14 and 15 which are approximately the same size. In this embodiment, these compartments lie alongside of each other and would contain approximately equal portions of material. The interiors of compartments 14 and 15 are connected at valve opening 12 (see FIG. 4).

Figure 7:
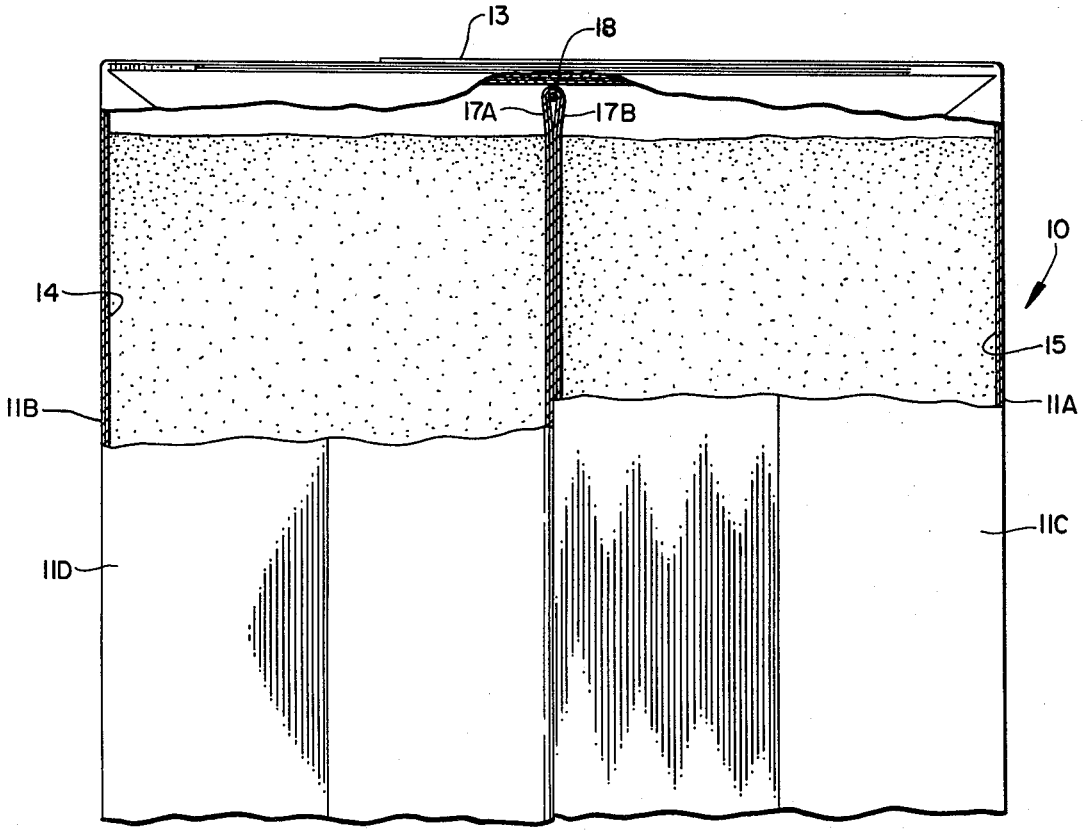
FIG. 7 is an enlarged sectional view of the structure of FIG. 4 taken along the line 7—7 thereof.

The top 13 of bag 10 is formed by folding together the top portions of the outside walls 11A–11D of the bag (the rear walls of compartments 14 and 15, are not shown), and then sealing the folded portions to prevent leakage of material out of the top 13 (see FIG. 7).

Figure 6:
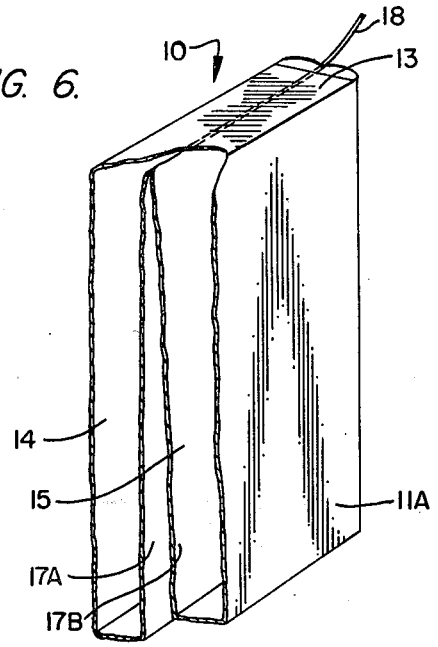
FIG. 6 is a cutaway view of the bag in FIG. 5.

The bottom of bag 10 (not shown) is formed similarly. The outside walls, 11A–11D, of the bag 10 together with inner walls 17A and 17B, form the walls of compartments 14 and 15. As shown in FIGS. 6 and 7, inner compartment walls 17A and 17B connect to each other but do not connect to top 13. Top 13 is also the top of compartments 14 and 15.

Bag 10 has a single valve opening 12 which connects into both compartments 14 and 15 for filling these compartments simultaneously. Opening 12 is positioned in top 13 of bag 10 so that after bag 10 is filled and disconnected from the outlet tube, opening 12 acts as a valve and does not permit the material in the compartments to leak out.

In the embodiment of the bag shown in FIGS. 3–9, the valve opening is in the folds of top 13. Forming such a valve opening in the top of a bag can be done by methods well-known in the art.

Figure 4:
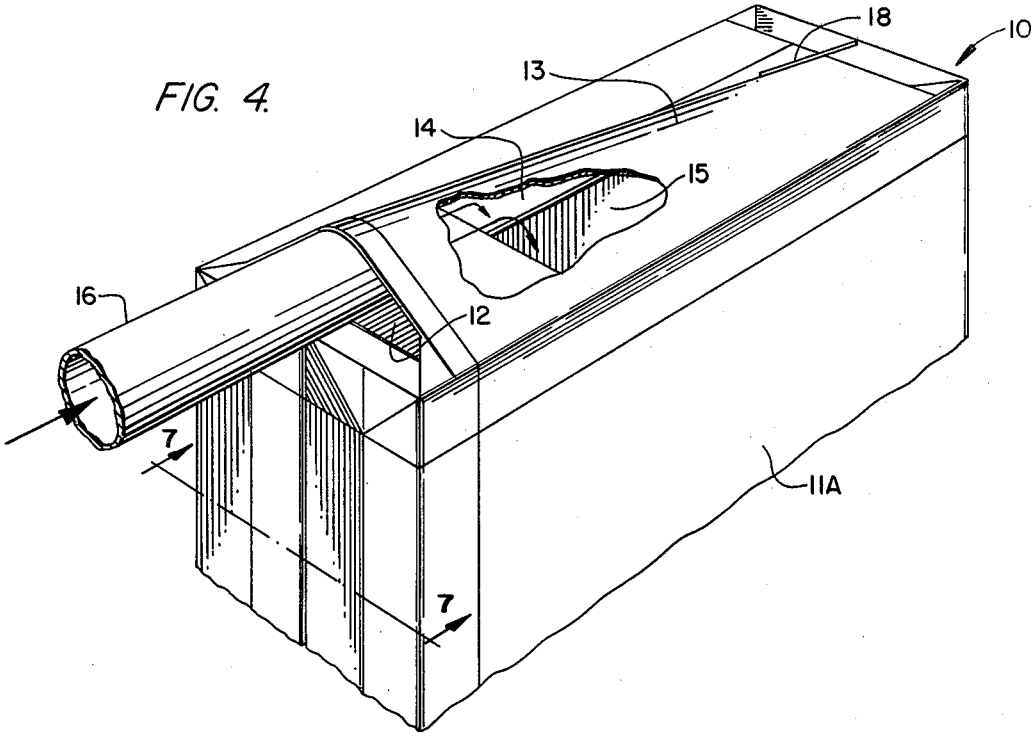
FIG. 4 is an enlarged view, partly broken away, of a portion of FIG. 3 showing an outlet tube in position in a valve opening and the bag partially filled.

As indicated above, a packaging device for filling the bags of this type has an outlet tube 16 (see FIG. 4). The tube 16 penetrates valve opening 12 while the bag is being filled. Typically, solid, particulate matter would flow through the outlet tube and into both compartments simultaneously.

The outlet tube needed to fill bag 10 of the present invention can be the same tube that is used presently to fill conventional bags. This, plus the fact that the double-compartment bag of this invention has substantially the same overall size and shape as the conventional bags, means that the double-compartment bag can be filled in the same way with the same equipment as is done presently.

In accordance with the invention, the bag further includes means for disconnecting the compartments from each other. In the preferred embodiment, this disconnecting means includes tear tape 18 which extends the length of top 13 along a line lying between compartments 14 and 15 (see FIG. 7). When tear tape 18 is pulled, compartment 15 is disconnected from compartment 14 and both compartments are opened (see FIG. 9).

After the two compartments are filled, each has half the weight and volume of a conventional bag, and can be individually moved and lifted after they are disconnected. Since the final movement and lifting is a manual operation, the benefits of a lighter load will be realized by the present invention. Furthermore, the double-compartment bag offers no disadvantages since the currently-used bag-filling machines would not need to be adapted or replaced, and the handling costs for the bag of this invention are no different from those of conventional bags.

In accordance with the invention, the bag may include retaining means between the compartments to prevent them from shifting with respect to each other during handling and shipping of the filled bags. The retaining means should also allow the compartments to separate without being injured.

The purpose of the retaining means is to prevent the filled compartments, which have significant weight when full, from moving and pulling against the disconnecting means. Without the retaining means, one of the filled compartments could shift during transport and pull the tear tape loose, causing the compartments to disconnect and open prematurely.

The retaining means keeps the force from the independent compartments' movement from damaging the disconnecting means. Once the compartments are disconnected, the retaining means should not prevent the bags from being moved independently, and the retaining means should not damage the compartments when they are separated. In the preferred embodiment, the retaining means is a small quantity of glue 19 connecting the most adjacent surfaces of the compartments.

Figure 10:
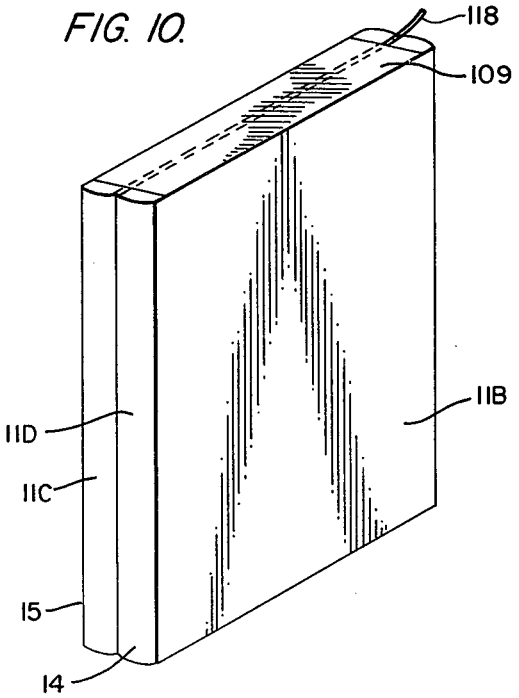
FIG. 10 is a bottom view of a bag having an alternate retaining means.

The retaining means could also be another piece of tear tape at, for example, the bottom of the bag as seen in FIG. 10. In FIG. 10, tear tape 118 in the bottom 109 of the bag acts as the retaining means and is pulled when the compartments are to be separated.

Figure 11:
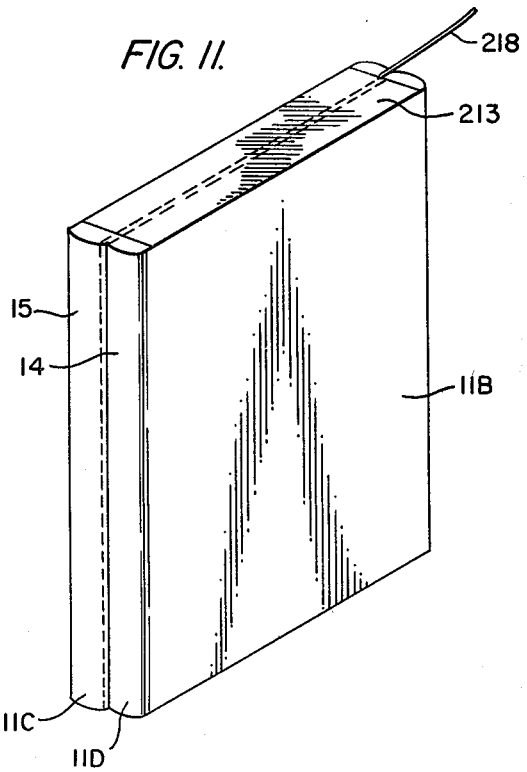
FIG. 11 is a rear view of a bag having an alternate retaining means.
Figure 8:
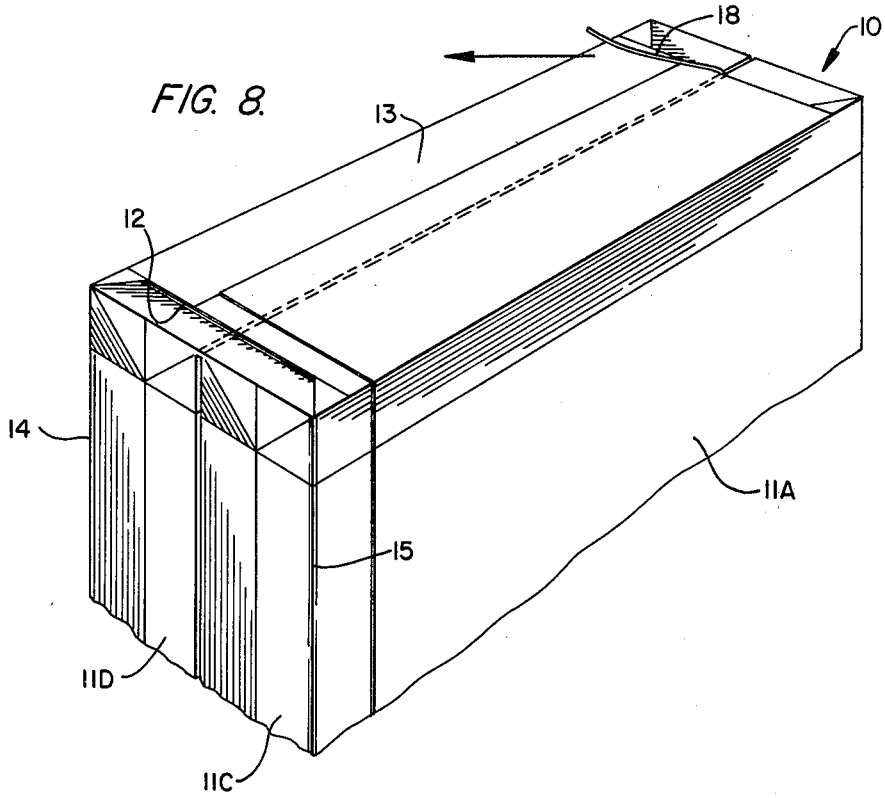
FIG. 8 is an enlarged view of a portion of FIG. 4 showing initial operation of the compartment disconnecting means.
Figure 9:
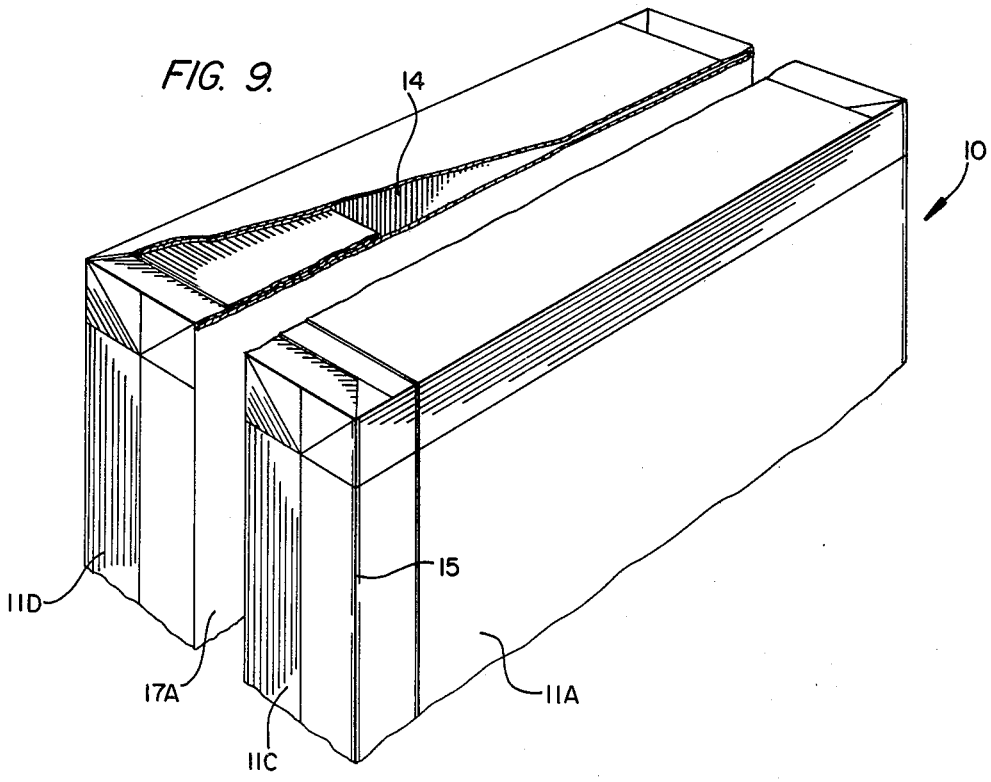
FIG. 9 is a view similar to FIG. 8 showing completion of compartment disconnection.

FIG. 11 shows yet another embodiment for the retaining means. FIG. 11 is a rear view of a bag which has a tear tape 218 extending across the top 213 of the bag and down the back of the bag. Besides disconnecting the compartments, tear tape 218 provides additional stability to the compartments.

It will be apparent to those skilled in the art that modifications and variations can be made in the bag of the present invention without departing from the scope or spirit of the invention. It is intended that the present invention cover the modifications and variations of this invention that come within the scope of the appended claims and their equivalents.

What is claimed is:

1. A closed bag comprising:

two adjacent, individual compartments having a common top section;

said two adjacent, individual compartments each having an outer side wall and an inner side wall said inner side walls interconnecting along at least one end;

a valve opening formed in said top section and connected to both of said compartments for filling said compartments simultaneously; and means extending between said two adjacent, individual compartments for dividing said top section and disconnecting said compartments from each other.

2. The bag in claim 1 wherein said disconnecting means comprises a length of tear tape between said compartments which is pulled to disconnect and open said compartments.

3. The bag in claim 2 wherein said bag is made of multiwall paper.

4. The bag in claim 2 wherein said bag is made of plastic.

5. The bag in claim 2 further comprising retaining means between compartments to prevent said compartments, when full, from shifting with respect to each other during handling and shipping, said retaining means allowing said compartments to disconnect without being damaged.

6. A closed bag comprising:

two adjacent, individual compartments having a common top section;

said two adjacent, individual compartments each having an outer side wall and an inner side wall said inner side walls interconnecting along at least one end;

a valve opening formed in said top section and connected to both of said compartments for filling said compartments simultaneously;

a length of tear tape extending between said compartments for dividing said top section and disconnecting said compartments for each other; and glue secured to opposite positions on both of said inner side walls whereby said two adjacent, individual compartments are prevented from shifting with respect to each other.

* * * * *

UNITED STATES PATENT AND TRADEMARK OFFICE

CERTIFICATE OF CORRECTION

PATENT NO. : 4,453,637

DATED : June 12, 1984

INVENTOR(S) : Jeffrey A. Mazur

It is certified that error appears in the above—identified patent and that said Letters Patent is hereby corrected as shown below:

Claim 6, Column 6, Line 2, change "for" to --from--.

Signed and Sealed this

*Second* Day of *April 1985*

[SEAL]

*Attest:*

DONALD J. QUIGG

*Attesting Officer*

*Acting Commissioner of Patents and Trademarks*